United States Patent [19]

Houston

[11] 4,245,632

[45] Jan. 20, 1981

[54] UNDERWATER BREATHING APPARATUS

[75] Inventor: Charles E. Houston, Gulf Breeze, Fla.

[73] Assignee: S.C.A.B.A., Inc., Gulf Breeze, Fla.

[21] Appl. No.: 74,904

[22] Filed: Sep. 12, 1979

[51] Int. Cl.[3] ..... B63C 11/20

[52] U.S. Cl. ..... 128/205.13; 128/201.11; 128/201.27; 128/204.26; 128/205.24

[58] Field of Search ..... 128/201.11, 201.27, 128/201.28, 202.29, 204.28, 205.14, 205.15, 205.17, 205.18, 205.24, 204.26, 205.16

[56] References Cited

U.S. PATENT DOCUMENTS

| | | | |
|---|---|---|---|
| 908,690 | 1/1909 | Neubert | 128/201.11 |
| 1,477,627 | 12/1923 | Campbell | 128/201.27 X |
| 3,050,055 | 8/1962 | Vautin | 128/205.18 |
| 3,124,131 | 3/1964 | Gross | 128/205.12 |
| 3,749,524 | 7/1973 | Jordan | 128/205.18 |
| 3,837,337 | 9/1974 | La Violette | 128/205.16 X |
| 4,022,201 | 5/1977 | Diggs | 128/201.11 |
| 4,061,140 | 12/1977 | Saito | 128/201.11 |

FOREIGN PATENT DOCUMENTS

| | | | |
|---|---|---|---|
| 918008 | 9/1946 | France | 128/201.11 |

*Primary Examiner*—Henry J. Recla
*Attorney, Agent, or Firm*—Richard D. Weber

[57] ABSTRACT

A self-contained underwater breathing apparatus wherein surface air is delivered through a float-supported hose to a compressor carried by the diver and powered by the diver's exhalations. The compressed air is stored in reservoirs and inhaled by the diver through a demand regulator. An auxiliary manually powered compressor is provided for startup, emergency use and to make up system losses.

16 Claims, 13 Drawing Figures

UNDERWATER BREATHING APPARATUS

BACKGROUND OF THE INVENTION

The present invention relates generally to underwater breathing devices for supplying air from the surface of a body of water to a diver beneath the surface, and relates more particularly to a self-contained breathing apparatus wherein the surface air is compressed by the diver himself during his underwater activities.

Aside from snorkeling equipment, with which a swimmer is usually limited to a depth of only a few feet below the surface, commercially available underwater breathing equipment falls essentially into two categories: systems wherein air is compressed at the surface and delivered to a diver through a hose; and the self-contained underwater breathing apparatus (scuba) systems characterized by tanks of compressed air which are carried by the diver. The scuba gear permits greater range and freedom of movement than the hose type systems but suffers the disadvantages of limited underwater duration and the encumbering bulk of the tanks. The surface supply systems are expensive and normally require a surface vessel as well as an attendant to monitor the compressor and to pay out or take in the lengthy hose as required by the extent of the diver's underwater travels.

Both of the conventional systems described permit a diver to dive to depths of at least several hundreds of feet with proper training and for such purpose their expense and complexity are tolerable. However, for relatively shallow diving, for example to depths of approximately twenty feet and less, a self-contained breathing apparatus which would utilize the inexhaustable supply of surface air would be more advantageous than either the scuba equipment with its limited duration or the hose type equipment with its surface located compressor.

There have been efforts in the past to develop a self-contained apparatus wherein the cam pressing force is supplied by the diver. For example, U.S. Pat. No. 3,050,055 discloses a system wherein surface air passing through a float-supported air inlet line is compressed by piston-cylinder units mounted on the diver's back and driven by the extension of the diver's legs which serves to extend piston springs which on release compress air drawn into the cylinders. Although such a system might be theoretically feasible, it is handicapped by the fact that the diver's legs must be constantly involved with the air compression function, allowing little time for swimming movement. Furthermore, such a system would be difficult if not impossible to operate while the diver is standing on the bottom or engaged in activities in which movement would not be desirable, such as observing wild life, or working in close quarters with other divers such as in hull inspection or underwater repairing.

A further attempt to free a diver from the limited duration tanks of the Scuba system is shown in U.S. Pat. No. 3,124,131 where air from the surface is drawn into an air reservoir on the diver's back by means of electric motors. While in theory providing a limitless duration of underwater activity, such a system has several drawbacks including a limited range due to the need for an electrical connection to the diver, not to mention the hazard of being wired to an electrical circuit while under water.

SUMMARY OF THE INVENTION

The present invention comprises a self-contained underwater breathing apparatus characterized by a compressor driven by the diver's exhaled air. Fresh air passes to the compressor through a hose suspended from a float and is compressed and delivered to an air reservoir from which it is drawn through a conventional demand regulator. The compressor may be either of the diaphragm type or the piston-cylinder type and in either case valve means is provided which releases the exhaled air from the compressor to atmosphere to permit a return of the diaphragm or piston, and effecting a charging of the compressor with fresh air from the surface. An auxiliary manually actuated compressor is provided to augment the primary compressor to offset any air shortages as might develop and to provide an emergency compressing source should there be failure of the primary compressor or other system components. Suitable check valves are provided to safeguard the pressurized air supply and to prevent water penetration into the compressors or air lines.

It is accordingly a first object of the present invention to provide a self-contained underwater breathing apparatus for shallow diving which permits the diver to remain under water for an unlimited time.

It is a further object of the invention to provide a self-contained underwater breathing apparatus as described which utilizes surface air but which does not require a compressor at the surface.

Another object of the invention is to provide breathing apparatus as described wherein the compression of the air is accomplished by the diver without reliance on a supplemental power source.

Still another object of the invention is to provide a breathing apparatus as described wherein the primary air compressor is driven by the diver's exhaust breath and wherein a secondary manual compressor is provided to compensate for system shortages or for use as a backup in case of emergency.

Still another object of the invention is to provide a breathing apparatus as described of a compact, simple, lightweight design which can be inexpensively manufactured.

A still further object of the invention is to provide a breathing apparatus as described which can safely be utilized by an inexperienced diver.

Additional objects and advantages of the invention will be more readily apparent from the following description of preferred embodiments thereof when considered in conjunction with the accompanying drawings.

DESCRIPTION OF THE PREFERRED EMBODIMENT

Figure 2:
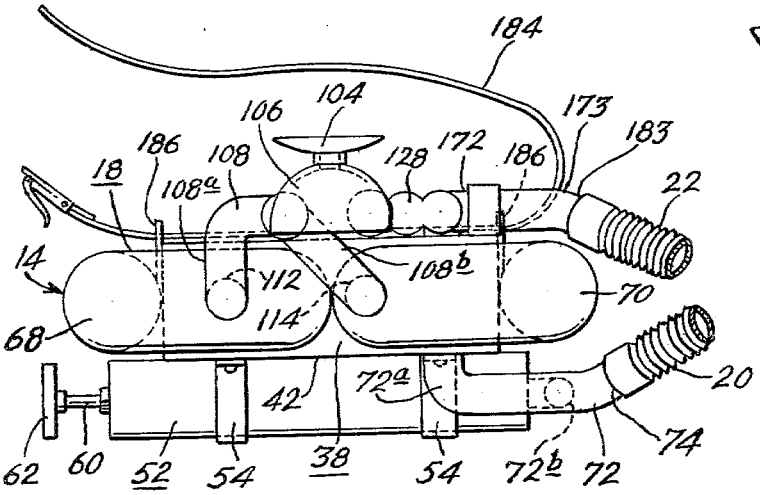
FIG. 2 is a plan view of that portion of the preferred embodiment of the present underwater breathing apparatus worn by the diver but shown with the air lines removed.
Figure 1:
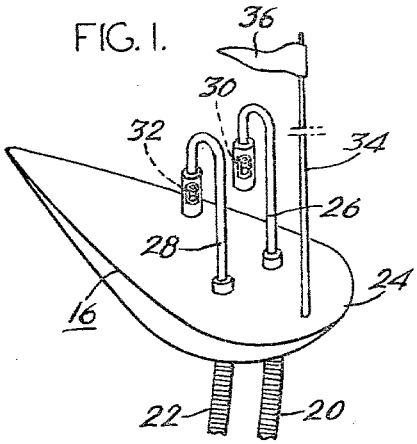
FIG. 1 is a reduced perspective view illustrating a float assembly including air intake and exhaust snorkel tubes which is a component of a preferred embodiment of underwater breathing apparatus in accordance with the present invention.
Figure 3:
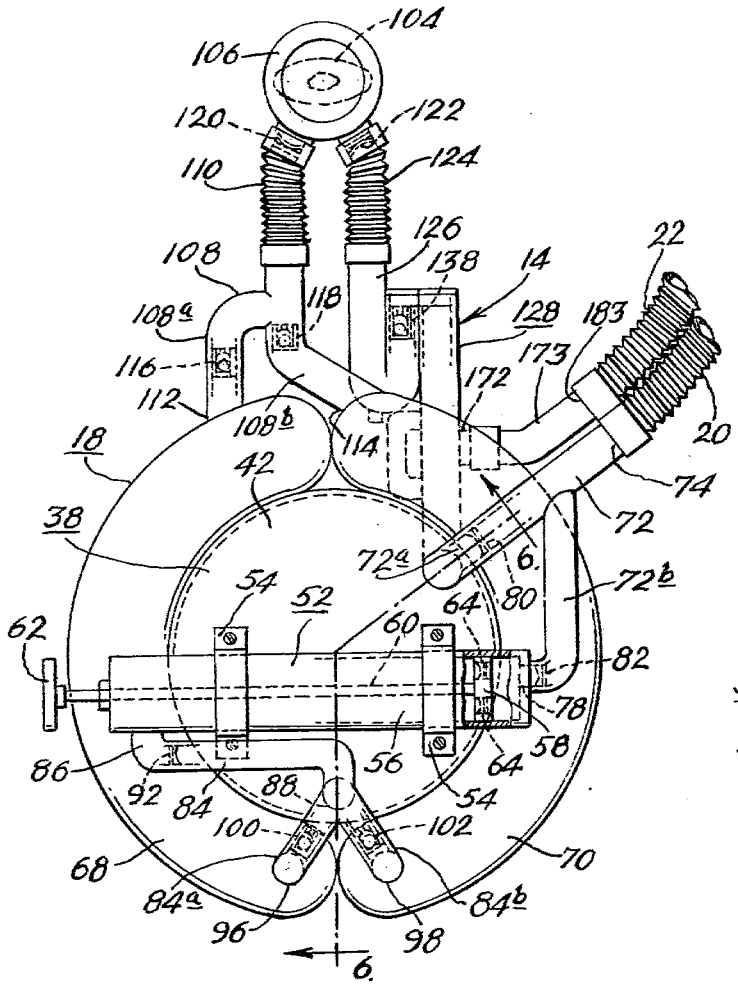
FIG. 3 is a front elevational view of the apparatus shown in FIG. 2.
Figure 4:
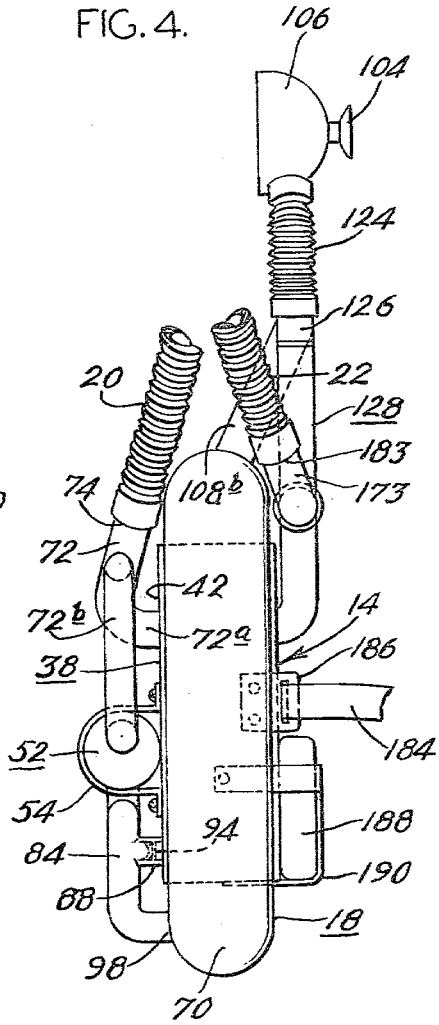
FIG. 4 is a side elevational view of the apparatus shown in FIGS. 2 and 3.

Referring to the drawings and particularly to FIGS. 1–4 thereof, a self-contained air breathing apparatus generally designated 14 in accordance with the present invention includes a float assembly 16 (FIG. 1) and a chest pack or backpack assembly 18 which are connected by a flexible air inlet hose 20 and exhaust air hose 22. The float assembly 16 includes a float element 24 having sufficient buoyancy to support the hoses 20 and 22 and preferably sufficient reserve buoyancy to support the diver and his gear during rest periods. Standpipes or snorkel tubes 26 and 28 having water check valves 30 and 32 respectively extend above the float element 24 and are respectively connected with the fresh air hose 20 and exhaust air hose 22. A flag staff 34 bearing a flag 36 is preferably mounted on the float element 24 to provide notice that a diver is operating in the vicinity of the float assembly.

Figure 6:
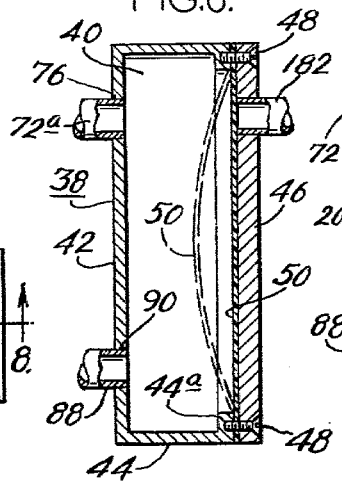
FIG. 6 is an enlarged sectional view taken along line 6—6 of FIG. 3 and showing details of the diaphragm type compressor.

The chest pack assembly 18 includes a central compressor 38 which as shown in section in FIG. 6, includes a cylindrical compressor chamber 40 formed by the flat circular front wall 42, cylindrical sidewall 44, and flat circular rear wall 46. The rear wall 46 is demountably attached to a flange portion **44*a* of the side wall 44 by screws 48. An elastic diaphragm 50 is secured between the flange portion 44*a* of the side wall 40 and the edge of the rear wall 46. As illustrated in the broken lined position of FIG. 6, the diaphragm is adapted to expand inwardly into the chamber 40** under certain pressure conditions to provide a pumping action as described herebelow.

An auxiliary compressor 52 in the form of a conventional hand pump is fastened to the exterior of the front wall 42 of compressor 38 by mounting brackets 54. Auxiliary compressor 52 comprises a cylinder 56 within which a piston 58 is slidably disposed and actuated by a piston rod 60 extending through a waterproof seal at one end of the cylinder and having a handle 62 attached at the extending end thereof. The piston 58 includes ports therein containing diaphragm type check valves 64 which allow air to pass through the ports upon movement of the piston in one direction only. Accordingly, in the present example the inward movement of the piston (pushing the handle 62 toward the cylinder 56) results in air passing from the right hand side to the left hand side of the piston as viewed in FIG. 3. The opposite movement of the piston, upon withdrawal of the handle 62 away from the cylinder 56 results in a compression of air to the left hand side of the piston and the creation of a low pressure zone in the portion of the cylinder on the right hand side of the piston as viewed in FIG. 3. For purposes of later discussion, the cylinder space on the right hand side of the piston in FIG. 3 will be designated as the suction end of the cylinder whereas the space on the left hand side of the piston will be designated as the compression end of the cylinder.

Compressed air storage means is provided which in the preferred embodiment comprises a pair of reservoirs 68 and 70. The reservoirs each comprise a cresent shaped flexible bladder of a suitable elastomeric material which preferably includes an integral mesh cover of nylon or other suitable material to permit the mounting of the bladders and to prevent overinflation thereof. The bladders are circumferentially disposed about the compressor 38 much in the manner of a tire about a wheel and thus serve to protect the compressor as well as cushion any casual contact by the swimmer's arms and body as may occur during diving and swimming movements.

Figure 5:
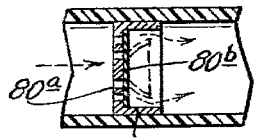
FIG. 5 is an enlarged sectional view showing the typical form of diaphragm type check valve utilized in the preferred embodiment of the invention.

The air intake hose 20 is connected with the compressor 38 and the auxiliary compressor 52 by means of an inverted Y-shaped connector 72, the upper end 74 of which is grooved to permit sealed attachment of the hose 20. One of the lower ends **72*a* of the connector 72 terminates in a port 76 in the front wall 42 of compressor 38, while the other end 72*b* thereof communicates with a port 78 in the suction end of the auxiliary compressor 52. Diaphragm type check valves 80 and 82 respectively disposed in the legs 72*a* and 72*b* of the member 72 permits air flow only into the respective compressors. FIG. 5 shows a typical diaphragm type check valve 80 having an apertured valve member 80*a* to one side of which a flexible diaphragm 80*b* is centrally secured. The diaphragm flexes to the dotted line position to permit air flow from left to right through member 80*a*** but closes to the solid line position to prevent flow reversal.

A compressed air manifold 84 serves to deliver compressed air from either the compressor 38 or auxiliarycompressor 52 to either or both of the compressed air reservoirs 68 and 70. The manifold 84 is connected at 86 with the compression end of the auxiliary compressor 52 and includes an extension 88 which communicates at port 90 with the chamber 40 of the compressor 38. Diaphragm type check valves 92 and 94 respectively restrict the flow of air to a flow path toward the reservoirs 68 and 70. The lower end of the manifold 84 is bifurcated, forming a pair of conduits **84*a* and 84*b* which respecitvely communicate with the reservoirs 68 and 70 at ports 96 and 98 therein. Ball type check valves 100 and 102 respectively in the conduits 84*a* and 84*b* prevent the passage of water from either reservoir 68 or 70** into the manifold in the event of a rupture of a reservoir.

The compressed air from the reservoirs 68 and 70 is consumed as needed by the diver through a conventional mouthpiece 104 and demand regulator 106 to which the compressed air is passed through a collector 108 and flexible air intake hose 110. The collector 108 includes conduits **108*a* and 108*b* which respectively communicate with the reservoirs 68 and 70 at ports 112 and 114. Ball type check valves 116 and 118 are respectively provided within the conduits 108*a* and 108*b* to prevent water from passing into the collector should one of the reservoirs be ruptured. A diaphragm type check valve 120 at the regulator end of hose 110** prevents exhaust air from entering the intake hose.

Figure 7:
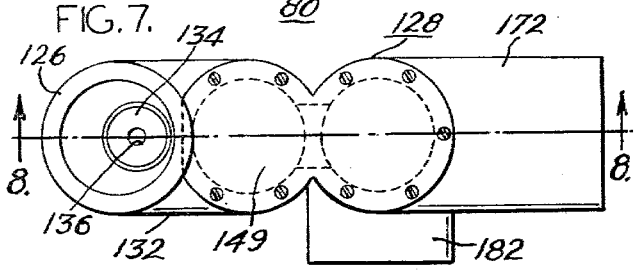
FIG. 7 is an enlarged plan view of the purge valve and control valve assembly of the embodiment shown in FIGS. 1–6.
Figure 8:
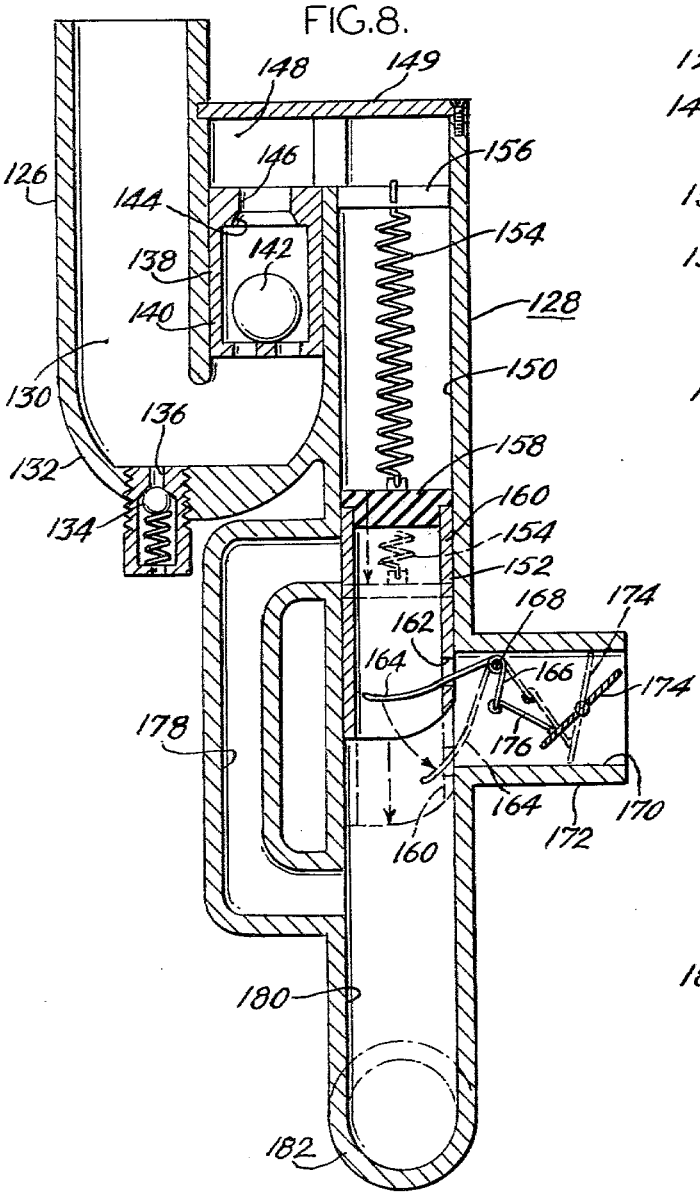
FIG. 8 is a sectional view taken along line 8—8 of FIG. 7.
Figure 9:
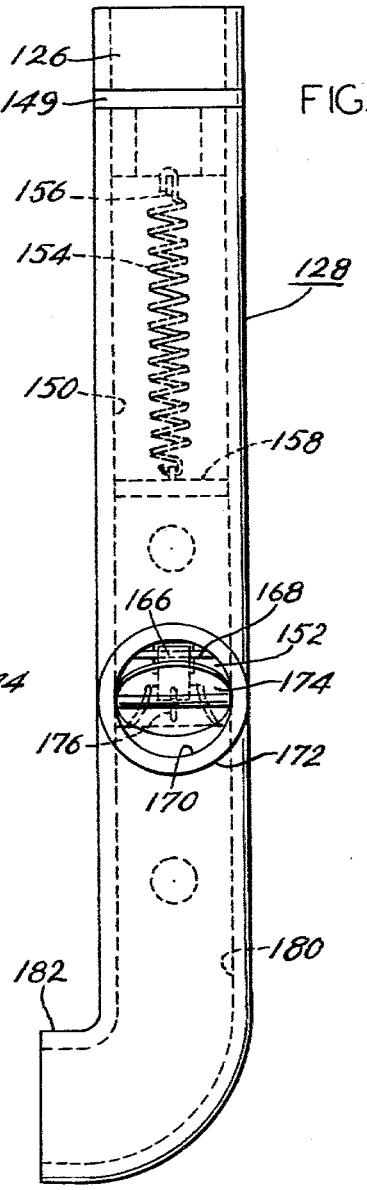
FIG. 9 is a side elevational view of the valve assembly shown in FIGS. 7 and 8.

A diver's exhalation or exhaust air passes through a diaphragm check valve 122 into exhaust air hose 124 and thence into the water purge means 126 and control valve assembly 128, details of which are most readily gained from the enlarged views of FIGS. 7–9.

The water purge means 126 includes a generally J-shaped chamber 130 formed within an integral housing 132 combining in a unitary structure both the water purge means 126 and the valve assembly 128. At the bottom of the chamber 130, a spring loaded ball type check valve 134 is provided to open a water exhaust port 136 upon the build-up of a predetermined pressure within the chamber 130. A ball type float valve 138 in the downstream leg of the chamber 130 includes a cage 140 within which a float ball 142 is encased. The ball is adapted upon the flooding of the cage to float upwardly and seat against a frusto-conical valve seat 144 adjacent a port 146, thereby preventing water passage into a chamber 148 leading into control valve assembly 128. Access to the chamber 148 may be gained by removal of cap plate 149 screwed to the housing 132.

The valve assembly 128 includes an elongated valve bore 150 within which a valve element 152 is slidably disposed. A tension spring 154 within the bore 150 is connected to the upper end of the valve element 152 and is fixed at its opposite end to a cross member 156 within the bore. The valve element 152 includes at its upper end a resilient plug 158 which is closely fitted within the bore 150 to prevent air flow therepast. Downwardly depending from the plug 158 is a hollow cylindrical member 160 open at the bottom and including a slot 162 therein through which passes leg 164 of bell crank 166 mounted on a pivot 168 in bore 170 of a conduit 172 which intersects the bore 150. A butterfly valve 174 pivotally mounted within the bore 170 is connected by link 176 to the bell crank 166. As may be seen by a comparison of the solid with the dotted line positions of the valve element 152, bell crank and butterfly valve, the downward vertical movement of the valve 152 from the solid line position to the dotted line position will result in a counterclockwise rotation of the bell crank and a resultant closure of the butterfly valve. Such a closure results when exhaust air passing through the water purge means and emerging from the port 146 thereof passes through the chamber 148 and into the upper end of the bore 150, forcing the valve element 152 downwardly against the tension force of spring 154. With the valve element 152 in the lower dotted line position, the exhaust air flows from the bore 150 through a bypass channel 178 formed in the casing 132 into the lower region 180 of bore 150 and thence into the compressor chamber 40. The lower end of the casing 132 forming the bore portion 180 includes a right angle bend such that the end 182 thereof may connect directly with the compressor 42. As shown in FIG. 2, conduit 172 joins into a connector 173 having a grooved end 183 for attachment of exhaust air hose 22.

The assembly 18 may be conveniently worn by the diver on either his chest or back and is held in position by means of belt 184 passing through apertured fittings 186 on each side of the compressor. A ballast weight 188 may be carried on bracket 190 attached to the compressor 38 to overcome the buoyancy of the diver.

In operation, the chest pack assembly 18 is strapped to the wearer and the belt 184 adjusted to provide a comfortable position of the device which does not interfere with normal underwater movements. The hoses 20 and 22 are connected to the chest pack assembly and the float assembly 16 is placed in the water at the location where the diving is to take place. The float and diver may be launched either from the shore such as from a beach or dock, or from a boat. Once the float and diver are in the water, the diver may swim at random in any direction, towing the float behind him. Alternatively, the diver may sit or lie upon the float and propell himself surfboard style to a desired diving location.

Prior to swimming under water, the diver should preferably prime the breathing apparatus using the auxiliary compressor 52. By pumping with the handle 62, air will be drawn in through the standpipe 26 and hose 20 into the leg **72*b* of tubing member 72, through check valve 82 and into the suction end of cylinder 56. When the handle 62 is pushed inwardly, the air in the suction end of the cylinder is prevented from passing back into the tubing member 72 by the check valve 82 and accordingly passes through the check valve 64 in the piston 58 and into the compression end of the cylinder. On the reverse stroke of the piston, the check valve 64 prevents the return of the air through the piston and the air is accordingly compressed and passed through check valves 92, 100 or 102 into the air reservoirs 68 and 70**.

On entering the water, the diver inhales through the mouthpiece 104 and accordingly draws air from the reservoir 68 and 70 through the check valves 116 and 118, hose 110, check valve 120 and the regulator 106. The inhaling function is exactly the same as that experienced in breathing from pressurized scuba tanks.

The exhaling function is somewhat different in that the force of the exhaled air serves to operate the compressor 38 to compress additional incoming air in the following manner. The exhaled air flows through check valve 122 and hose 124 into the water purge means 126 which will purge water which may have entered through the mouthpiece. Water present in the chamber 130 will float the ball 142 against the valve seat 144, thereby causing a pressure increase in the chamber 130 which upon reaching a predetermined level will open the check valve 134 and purge any water present. With the water removed, the exhaust air will travel through port 146 into chamber 148 and thence downwardly within bore 150, acting against the plug 158 to depress the valve element 152 into its lowered position as shown in broken lines in FIG. 8. With the valve element in the lowered position, the exhaust air flows around bypass 178 into the lower region 180 of the bore 150. Since the lowering of the valve element 152 closes the butterfly valve 174, the air passes downwardly into the compressor, expanding the diaphragm 50 in the manner shown in the broken lines of FIG. 6 to thereby compress the air in the chamber 40. Since the check valve 80 prevents air flow from the chamber 40 back into the conduit portion **72*a*, the compressed air in chamber 40 is passed through manifold extension 88 and check valve 94 into the manifold 84 and thence into air reservoirs 68 and 70**.

At the end of the flow of exhaled air, the spring 154 returns the valve element 152 to its raised position as shown in solid lines in FIG. 8, thereby closing the bypass 178 and opening the butterfly valve 174. The elasticity of the diaphragm 50 then returns the diaphragm to its flat condition shown in FIG. 6 and in so doing forces the exhaust air out through the valve bore portion 180 and past the butterfly valve 174 into air exhaust hose 22 through which it passes to the surface, exiting through standpipe 26. The returning of the diaphragm to its original flat condition also serves to draw fresh air into the compressor chamber 40 through the air inlet hose 20, check valve 80 and leg 72*a* of tubing member 72. The compressor is then charged and ready to deliver fresh air to the air reservoirs from the next delivery of exhaled air to the compressor. Although it will be recognized that somewhat more effort than usual is required by the diver to exhale, it has been found that this extra effort is not unreasonable and since the apparatus is intended for relatively shallow depths, for example 20 feet or less, the pressure requirements of the compressor are relatively low.

Figure 10:
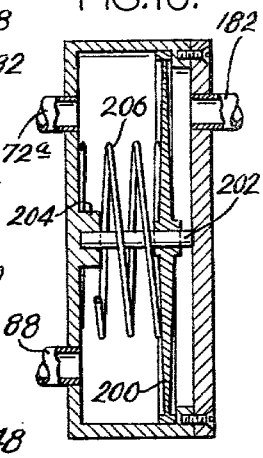
FIG. 10 is a sectional view showing an alternate form of compressor of the piston-cylinder type.

A modified form of compressor is shown in FIG. 10 wherein the diaphragm has been eliminated in favor of a piston 200 slidable along a central piston rod 202 extending from a boss 201 on the front face of the compressor housing. A compression coil spring 206 disposed between the piston and the front of the housing serves to urge the piston toward the right as viewed in FIG. 10. The compressor of FIG. 10 works in exactly the same manner as the diaphragm type compressor of FIG. 6, the movement of the piston 200 toward the left under the influence of the exhaust air compressing the air in the chamber to the left side of the piston in the same manner as the elastic flexing of the diaphragm. Similarly, at the end of the flow of exhaled air, the spring 206 moves the piston to the right thereby drawing fresh air into the compresssor chamber and driving the exhaust air to the surface.

Figure 11:
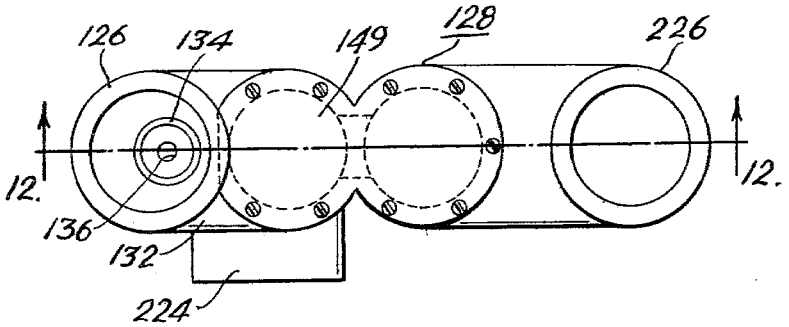
FIG. 11 is a view similar to FIG. 7 but showing an alternate form of purge and control valve.
Figure 12:
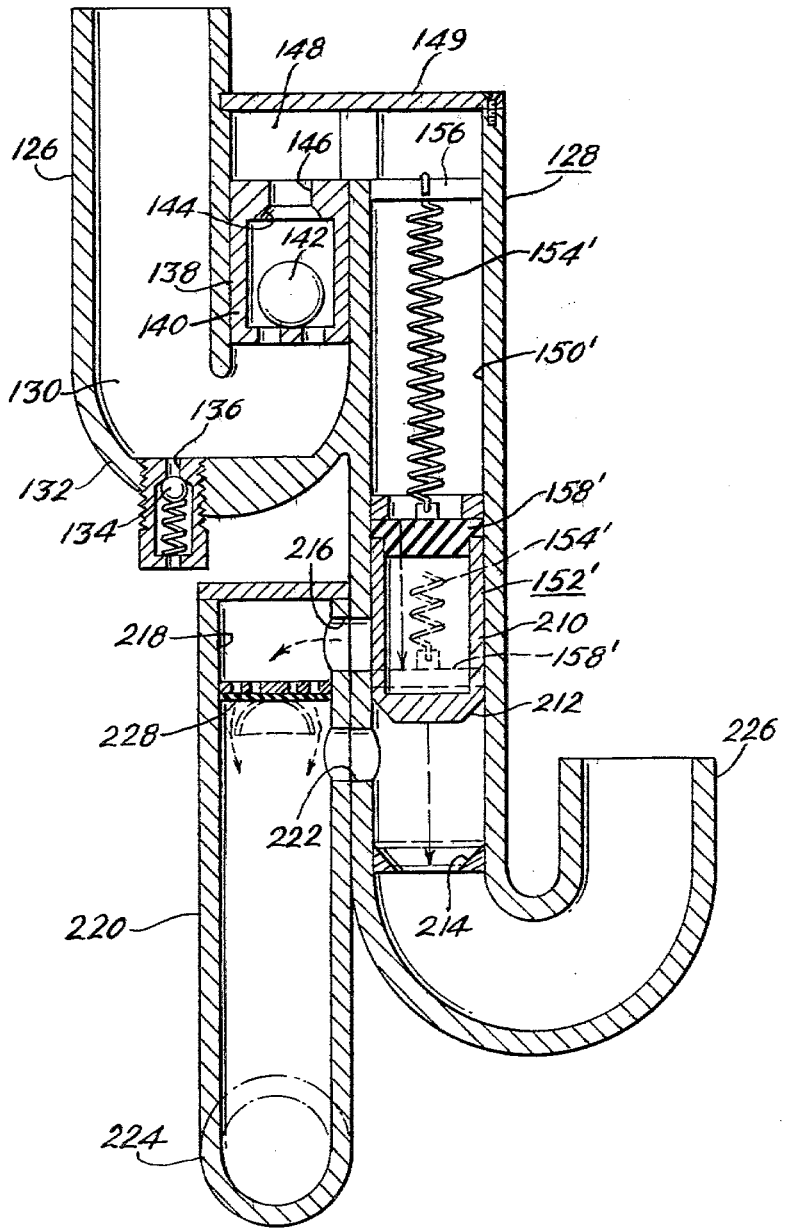
FIG. 12 is a sectional view taken along line 12—12.
Figure 13:
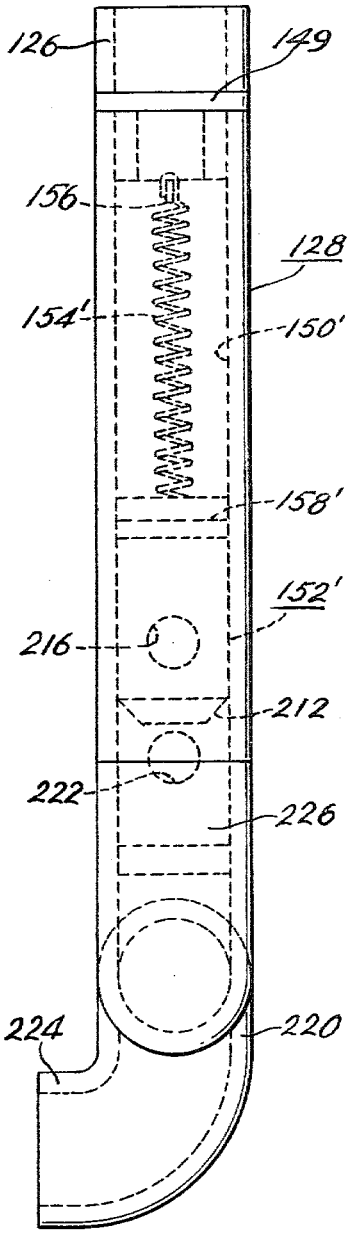
FIG. 13 is a side elevational view of the apparatus shown in FIGS. 11 and 12.

In FIGS. 11–13 a modified form of combined water purge means and control valve is illustrated. The water purge means is unchanged from the previously described embodiment but the control valve has been substantially modified to eliminate the butterfly valve and the bypass arrangement. In the modified embodiment, the valve element 152' includes a resilient plug 158' which substantially seals the bore 150' while permitting sliding movement of the valve element as in the previously described embodiment. The valve element includes a closed hollow cylindrical portion 210 depending from the plug 158' which at its lower end includes a frusto-conical seating surface 212 adapted to seat in sealing engagement with a frusto-conical valve seat 214 disposed near the lower end of the bore 150'. Tension spring 154' urges the control valve element 152' into the solid line position of FIG. 12 wherein the valve element blocks a port 216 extending between the bore 150' and a bore 218 formed by an adjoining auxiliary housing 220. In the raised position of the valve element 152', a second port 222 joining the bores 150' and 218 is disposed beneath the valve element 152' and accordingly permits communication and the flow of air between these two ports. With the lower end 224 of the auxiliary casing 220 comprising the input into the compressor, upon termination of compression the exhaust air will flow upwardly through bore 218 and port 222 into bore 150' and thence through the open valve seat 214 and out through the U-shaped end 226 of the casing which connects with the exhaust air hose 22. An air check valve 228 of the type shown in FIG. 5 is provided in the bore 218 between the ports 216 and 222 and permits a downward air flow only, thereby blocking the flow of exhaust air from the compressor into the upper end of the bore 218.

When the diver exhales, the exhaust gases force the valve element 152' into its lower dotted line position (FIG. 12) thereby opening port 216 to the bore 150' and permitting exhaust air to flow into the bore 218, through the check valve 228 and into the compressor to actuate the compressor diaphragm. In the lower position of the valve element 152', the port 222 is blocked by the cylindrical portion 210 of the valve element, and the surface 212 of the valve element 152' engages the valve seat 214 to further prevent the flow of exhaust gas downwardly through the bore 150' to the exhaust air hose.

Since the diver's exhaled air volume will normally be substantially equal to the inhaled volume, the air reservoirs need not be large and in the preferred embodiment each air reservoir should have a normal inflated capacity of approximately one and one half liters. The compressor in the preferred embodiment has a capacity of approximately two liters. After a period of use, it is expected that system losses will result in a depletion of the compressed air supply in the reservoirs, which will become evident to the diver due to the condition of the reservoirs as well as a noticeable difficulty in breathing. This may be quickly corrected as indicated above by a few strokes of the auxiliary compressor.

The materials from which the apparatus is fabricated should preferably be lightweight, corrosion proof materials such as plastics and lightweight alloys. The air hoses 20 and 22 should be flexible but have a sufficient supporting structure such as a spiral spring core to prevent collapse due to water pressure. Although the length of these hoses may vary depending upon the intended use of the device, a length of approximately thirty feet is suggested to give the diver ample underwater range without need for towing the float with each underwater movement. The ballast weight is preferably a lead weight of approximately fifteen pounds but may be lighter or heavier to suit the particular embodiment of the invention and the physical characteristics of the diver.

Although the apparatus is intended primarily for underwater use, it will be obvious that is could also be used for circumstances in which the air in the wearer's immediate environment is unsuitable for breathing such as in mines or tunnels, emergency use in conditions of noxious gases or smoke, etc.

The use of water check valves and water purge means as well as the preferred use of dual air reservoirs permits continued operation of the device even in the event of a puncture of one of the reservoirs. Should the primary compressor malfunction or flood, the auxiliary compressor can be used to reach the surface. Since the device is intended only for shallow diving, the surface should be easily reachable within a few strokes should a malfunction occur.

Manifestly, changes in details of contruction can be effected by those skilled in the art without departing from the spirit and scope of the invention.

I claim:

1. Self-contained underwater breathing apparatus comprising an air-driven compressor including means driven by the exhalation of a diver for compressing air therein, an air inlet hose open to surface air at one end and connected to said compressor at the other end for transferring surface air to said compressor to be compressed, a compressed air reservoir connected to said compressor to receive said compressed air therefrom, conduit means for delivering said compresssed air from said reservoir to a diver, means in said conduit means for controlling the pressure of the air delivered therethrough, conduit means for delivering the diver's exhaled air to said compressor to drive said compressor, an exhaust air hose open to the surface at one end and connected to the compressor at the other end, and valve means for releasing the exhaled air from said compressor into said exhaust air hose upon termination of the diver's exhalation.

2. The apparatus as claimed in claim 1 wherein said compressor comprises an air compressing element movably mounted within said compressor to compress air therein and means resiliently returning said element upon termination of exhalation to evacuate said exhaled air through said exhaust air hose from the compressor and to draw a fresh charge of surface air through said air inlet hose into the compressor.

3. The invention as claimed in claim 1 wherein said compressor comprises a resilient diaphragm mounted within said compressor to compress air therein and which is expanded by the diver's exhaled air during the compression phase and elastically contracts to evacuate the exhaled air through said exhaust air hose from the compressor and to draw a fresh charge of surface air through said air inlet hose into the compressor upon termination of exhalation.

4. The invention as claimed in claim 2 wherein said compressor comprises a piston driven within a cylinder by the exhaled air, and a spring biasing said piston against movement by the exhaled air, said spring serving to move said piston upon termination of exhalation to force exhaled air from the compressor and draw a fresh charge of air into the compressor.

5. The invention as claimed in claim 1 wherein said apparatus includes an auxiliary compressor connected between said air inlet hose and said reservoir and manually actuatable by the diver to supplement the function of said air-driven compressor during startup, emergencies or to make up system losses.

6. The invention as claimed in claim 1 including water purge means in said conduit means for purging excess water therefrom as the diver's exhaled air is delivered to said compressor.

7. The invention as claimed in claim 1 including a float for supporting the upper ends of said air inlet hose and said exhaust air hose above the surface of the water during operation of the apparatus.

8. The invention as claimed in claim 7 including water check valves in float-supported ends of said air inlet hose and exhaust air hose to prevent water from entering the hoses.

9. The invention as claimed in claim 1 wherein said means for controlling the pressure of the air delivered through said conduit means to the diver comprises a demand regulator.

10. A self-contained underwater breathing apparatus comprising a pack assembly to be worn by a diver, air inlet and exhaust air hoses connected to said pack assembly, and a float assembly for supporting the upper ends of said air inlet and exhaust air hoses above the water surface and open to the atmosphere; said pack assembly including an airdriven compressor having an inlet and an outlet and including means driven by the exhalation of a diver for compressing air therein, the lower end of said air inlet hose being connected to the inlet of said compressor for transferring air thereto, a check valve permitting air flow through said air inlet hose only toward said compressor, said pack assembly including a compressed air reservoir, conduit means connecting the outlet of said compressor to said compressed air reservoir, a check valve in said conduit means permitting air flow only toward said air reservoir, conduit means for delivering compressed air from said reservoir to a diver, a demand regulator in said latter conduit means for controlling the pressure of the air delivered therethrough, conduit means for delivering the diver's exhaled air to said compressor to drive said compressor, valve means for releasing the exhaled air from said compressor into said exhaust air hose upon termination of the diver's exhalation, said compressor including an air compressing element movable within said compressor for compressing air therein means for resiliently returning said air compressing element upon termination of exhalation to evacuate the exhaled air through said exhaust air hose and to draw a fresh charge of surface air through said air inlet hose into the compressor, and a manually actuatable auxiliary compressor connected between said air inlet hose and said air reservoir to supplement the air-driven compressor upon startup, during emergencies, or to make up system losses.

11. The invention as claimed in claim 10 including water purge means in said conduit means for purging excess water therefrom as the diver's exhaust air is delivered to the air-driven compressor.

12. The invention as claimed in claim 10 wherein said pack assembly includes a second air reservoir connected in parallel with said compressors and said conduit means for delivering compressed air to a diver, and water check valves in said conduit means connecting said compressors with said air reservoirs and said air reservoirs with said diver to permit functioning of the apparatus in the event one of the reservoirs is flooded.

13. The invention as claimed in claim 10 wherein said air-driven compressor is a diaphragm-type compressor including a resilient diaphragm, the elastic return of said diaphragm serving to evacuate the exhaled air from the compressor and draw a fresh charge of surface air into the compressor upon termination of the exhalation.

14. The invention as claimed in claim 10 wherein said air-driven compressor comprises a piston-cylinder type compressor and including a spring for urging the piston against the force of the exhaled air, said spring serving to move the piston to force the exhaled air from the compressor and draw a fresh charge of surface air into the compressor upon termination of the exhalation.

15. The invention as claimed in claim 10 wherein said valve means for releasing the exhaled air from the compressor into the exhaust air hose upon termination of exhalation comprises a spring-loaded valve element in said conduit means which is displaced by the diver's exhalation to open a flow path permitting passage of the diver's exhalation into the compressor while simultaneously closing a flow path from the compressor into the exhaust air hose, said valve element upon termination of exhalation returning to a position blocking the flow path of exhaled air into the compressor and opening the flow path from the compressor into the exhaust air hose.

16. The invention as claimed in claim 10 including a mouthpiece for delivering compressed air to and receive exhaled air from a diver, and check valves associated with said mouthpiece for providing the correct flow direction of compressed and exhaled air.

* * * * *